US005251519A

United States Patent [19]

Lang

[11] Patent Number: 5,251,519

[45] Date of Patent: Oct. 12, 1993

[54] T-HANDLE WRENCH KIT

[76] Inventor: John W. Lang, 7062 Shady Arbor, Houston, Tex. 77040-4725

[21] Appl. No.: 35,162

[22] Filed: Mar. 22, 1993

[51] Int. Cl.[5] ..... B25G 3/12; B25B 13/02

[52] U.S. Cl. ..... 81/177.2; 81/180.1; 81/DIG. 8

[58] Field of Search ..... 81/177.2, 177.1, 177.5, 81/177.85, 180.1, 185.2, DIG. 8

[56] References Cited

U.S. PATENT DOCUMENTS 3,905,256 9/1975 Foley ..... 81/177.2 X 3,996,821 12/1976 Murray ..... 81/177.2

4,485,702 12/1984 Swan et al. ..... 81/177.2 X

*Primary Examiner*—D. S. Meislin

*Attorney, Agent, or Firm*—Norman B. Rainer

[57] ABSTRACT

A wrench kit for servicing threaded components such as nuts and bolts that are not easily accessible consists of a wrench member and a plurality of heads releasibly engagable by the wrench member. The wrench member has a shaft elongated between proximal and distal extremities. An operational block, disposed at the distal extremity, is capable of securing a head in orthogonal relationship to the shaft. The proximal extremity is provided with a straight turning handle that penetrates the shaft in T-shaped relationship.

4 Claims, 2 Drawing Sheets

T-HANDLE WRENCH KIT

BACKGROUND OF THE INVENTION

1. Field of the Invention

This invention relates to hand tools for turning threaded machine nuts and bolts, and more particularly concerns a wrench for engaging nuts and bolts that are not easily accessible.

2. Description of the Prior Art

Numerous wrenches have earlier been disclosed for use on machine bolts that cannot be directly viewed by the mechanic or other person utilizing the wrench. Such devices are designed to grip a nut or the head of a machine bolt, said nut or head having a square or hexagonal shape. By virtue of specialized design features, such devices enable the mechanic to reach and turn nuts and bolts that would be otherwise inaccessible because of either tight quarters or obscured view.

U.S. Pat. No. 4,718,316, for example, discloses an attachment for a common wrench, said attachment having a magnetic head which facilitates the starting of nuts upon bolts positioned in a location inaccessible for both hands of the person using the wrench.

U.S. Pat. No. 4,406,188 discloses a nut-holding attachment for an open-end wrench with fixed jaws, and is designed to prevent the wrench from falling off a nut or bolt during tightening.

U.S. Pat. No. 4,901,608 discloses a ratchet wrench having a pivoted head which permits adjustability of the angle of the head relative to the handle of the wrench. Although such devices find specialized uses in certain specific applications, they lack versatility in coping with the general problem of manipulating inaccessible threaded members.

Various wrenches have been employed in attempts to specifically reach the nuts which engage the lower extremity of a sink faucet and are referred to as basincock wrenches. These wrenches typically have an elongated shaft having a lower extremity associated with a T-handle, and an upper extremity having pivotally associated paired spring loaded jaws. The jaws are manually spread and wrapped around the nut. When the shaft is turned, the jaws engage the nut and loosen or tighten it. There are several shortcomings of such a wrench. The jaws are not easily engaged with the nut, and slippage may occur, thereby damaging the nut. The jaws do not have enough gripping force to effect rotation of an extremely tight nut. Furthermore, in order to reverse direction of torque, the wrench must be removed and the jaws pivoted over the shaft, and then re-engaged with the nut.

Another type of wrench adapted to engage nuts and bolts of substantially inaccessible nature is commonly referred to as a crowfoot wrench. The crowfoot wrench consists of a flat open end wrench at one extremity and a square aperture at the opposite extremity. The square aperture is adapted to be engaged by a square drive ratchet wrench extension post. The crowfoot wrench requires the use of a rachet wrench and extender. Often there is not sufficient room to effect the arcing motion of the rachet wrench in tight spaces. Moreover, the crowfoot wrench is engaged with the extension post by inserting the square end through the aperture. Generally in order for the parts to interlock, the square extremity must completely penetrate the aperture with a portion extending beyond the wrench. This protruding post portion renders it impossible to position the crowfoot wrench flush against a flat surface.

It is accordingly an object of the present invention to provide a wrench adapted to engage and transmit rotational force upon a nut or bolt located in a location which is otherwise substantially inaccessible.

It is another object of the present invention to provide a wrench of the aforesaid nature which may be positioned flush to a flat surface.

It is a further object of this invention to provide a kit comprised of a wrench of the aforesaid nature and removable fittings adjustable to a plurality of nut and bolt sizes.

It is yet another object of this invention to provide a wrench of the aforesaid nature which is simple to use, of durable construction, and amenable to low cost manufacture.

These and other beneficial objects and advantages will be apparent from the following description.

SUMMARY OF THE INVENTION

The above and other beneficial objects and advantages are accomplished in accordance with the present invention by a wrench kit comprising a wrench adapted to apply rotational force to a square or hexagonal fastener having parallel surfaces, said kit comprised of:

1) a wrench member comprised of:
   a) a shaft elongated upon a longitudinal axis between proximal and distal extremities and having a bore penetrating said shaft adjacent said proximal extremity in orthogonal relationship to said longitudinal axis,
   b) an operational block having a rear extremity associated with the distal extremity of said shaft, a forward extremity defined by a panel orthogonally disposed to said axis and bounded in part by flat forward and rearward surfaces, said forward surface bifurcated by a receiving groove containing a central aperture, and a cylindrical channel coaxially aligned with said longitudinal axis and communicating with said forward surface,
   c) retaining means adapted to freely reciprocate within said channel and urged by a coil spring toward said forward surface, said retaining means having a forward end and maintained within said channel by said rearward surface, and configured such that said forward end penetrates said aperture,
   d) a flat plate affixed to said forward surface and thereby covering said groove in a manner to create a passage of rectangular configuration, and
   e) a straight handle held by said bore, and
2) a plurality of heads, each having a working extremity equipped with fixed parallel jaws adapted to engage the parallel surfaces of said fastener in close conformity therewith, an elongated mounting extremity adapted to slidably engage said passage and having a locking recess adapted to be engaged by the forward end of said retaining means, and a shoulder adapted to abut said block.

In a preferred embodiment, the plurality of heads includes a selection of standard and metric sizes. In alternative embodiments, the heads may have a box and wrench configuration in which a hexagonal aperture is adapted to engage the fastener. A conventional ratchet mechanism may be interactive between the operational block and shaft.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
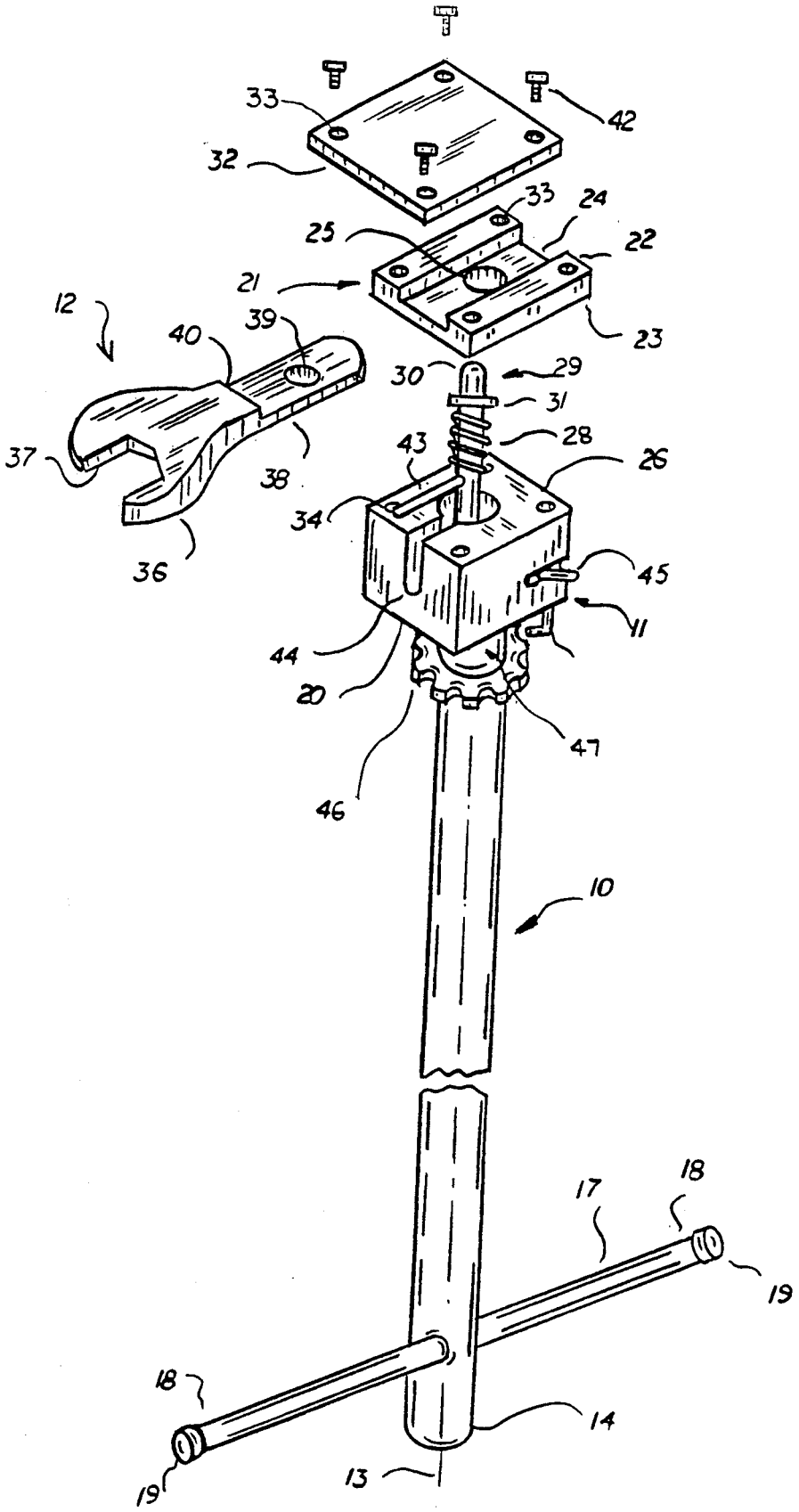
FIG. 1 is an exploded perspective view of an embodiment of the wrench kit of the present invention.
Figure 2:
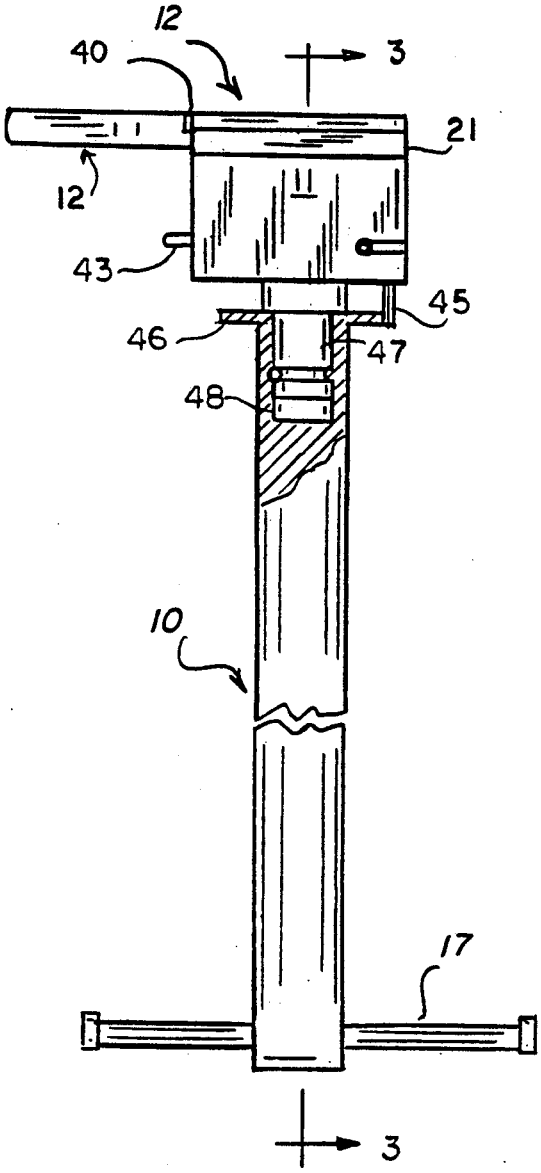
FIG. 2 is a side view of the embodiment of FIG. 1 with portions broken away to show interior details.
Figure 3:
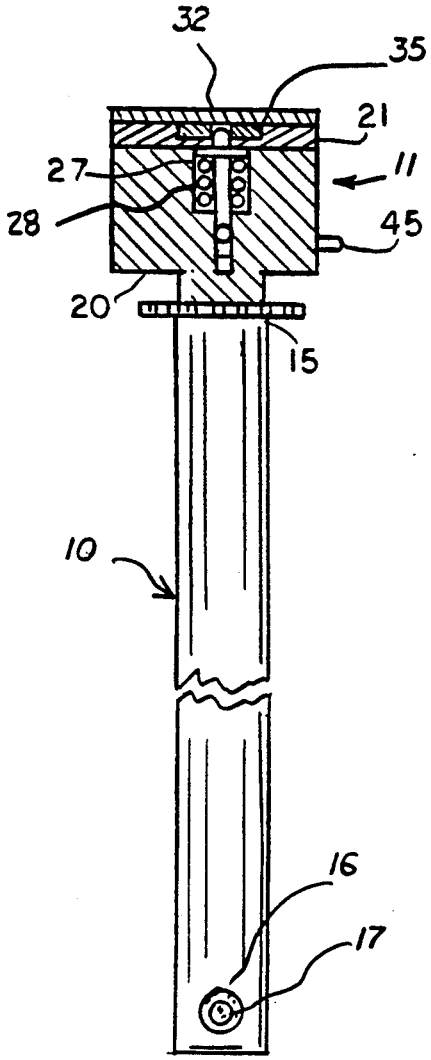
FIG. 3 is a fragmentary sectional view taken in the direction of the arrows upon line 3—3 of FIG. 2.

Referring to FIGS. 1-3, an embodiment of the wrench of the present invention is shown comprised of shaft 10 having operational block 11 that secures removable head 12.

Shaft 10 is elongated upon longitudinal axis 13 between proximal and distal extremities 14 and 15, respectively. A bore 16 penetrates shaft 10 adjacent said proximal extremity in orthogonal relationship to axis 13. A straight handle 17 elongated between opposed extremities 18 is slidably secured by bore 16, said extremities having stop means in the form of knobs 19 which prevent complete passage and resultant separation of said handle. Handle 17 functions to permit manual torque to be applied about axis 13.

Operational block 11 has a rearward extremity 20 associated with the distal extremity 15 of shaft 10. Said association may be fixed, as by way of welding, threaded engagement, or integral construction wherein shaft 10 and receiving block 11 are portions of a monolithic structure. However, in the exemplified embodiment, block 11 is rotatably associated with shaft 10 by way of a ratchet mechanism comprising toothed wheel 46 affixed to shaft 10, and pawl arm 45 pivotably held by said block and adapted to engage the teeth of wheel 46 in either of two directions. Rotating support post 47, downwardly emergent from rearward extremity 20, enters receiving well 48 within distal extremity 15 of the shaft. The ratchet mechanism accordingly permits rotation of block 11 in clockwise or counter clockwise directions.

The forward extremity 26 of said operational block is covered by panel 21 orthogonally disposed to axis 13 and bounded in part by flat forward and rearward surfaces 22 and 23, respectively. Forward surface 22 is divided into two sections by virtue of straight receiving groove 24 containing central aperture 25. A receiving channel 27, disposed within said receiving block in coaxial alignment with axis 13, communicates with forward extremity 26.

A holding rod 29, surrounded by coil spring 28 is housed within channel 27 and adapted to undergo sliding reciprocal movement within said channel. Rod 29 has a rounded forward portion 30 positioned and configured to penetrate aperture 25. Annular shoulder 31, outwardly directed from rod 29 is adapted to abut against rearward surface 23 of panel 21, thereby controlling the extent of passage of forward portion 30 through aperture 25. Shoulder 31 further serves as upper retaining means for spring 25. A release lever 43 attached to rod 29 enables said rod to be forced downwardly against the urging of spring 28, thereby retracting forward portion 30 from its penetrative association with aperture 25. A relief slot 44 is disposed within block 11 to accommodate lever 43.

A flat plate 32 is attached to panel 21 by bolts 42 which pass through aligned holes 33 in said plate and panel, and are secured by threaded recesses 34 in forward extremity 26 of said operational block. By virtue of the aforesaid combination and interaction of components, a passage 35 of rectangular configuration is created forwardly of block 11.

One extremity of head 12 is a working extremity 36 equipped with fixed parallel jaw surfaces 37 adapted to closely embrace the parallel surfaces of a square or hexagonal nut or bolt head. A mounting extremity 38 is disposed opposite said working extremity. Said mounting extremity is configured to make a close-fitting sliding engagement with passage 35. A securing recess 39, which may be a hole or merely a depression, is positioned within mounting extremity 38 so as to align with central aperture 25. A shoulder 40 is disposed between the working and mounting extremities of head 12. The function of shoulder 40 is to abut against plate 32 when mounting extremity 38 is fully inserted into passage 35. At such position of full insertion, spring 28 urges rod 29 forwardly so that its rounded forward portion 30 seats within recess 39. Such mode of action prevents inadvertent release of head 12 from passage 35.

Figure 4:
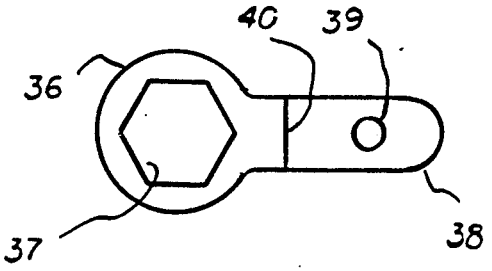
FIG. 4 is a plan view of an alternative head useful in the embodiment of FIG. 1.

Whereas the embodiment of head 12 exemplified in FIG. 1 is an open end box wrench, other head configurations are contemplated, such as the hex wrench disclosed in FIG. 4.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A wrench kit comprising a wrench adapted to apply rotational force to a square or hexagonal fastener having parallel surfaces, said kit comprised of:

1) a wrench member comprised of:

a) a shaft elongated upon a longitudinal axis between proximal and distal extremities and having a bore penetrating said shaft adjacent said proximal extremity in orthogonal relationship to said longitudinal axis, b) an operational block having a rear extremity associated with the distal extremity of said shaft, a forward extremity defined by a panel orthogonally disposed to said axis and bounded in part by a rearward surface and a flat forward surface bifurcated by a receiving groove containing a central aperture, and a cylindrical channel coaxially aligned with said longitudinal axis and communicating with said forward surface, c) retaining means adapted to reciprocate within said channel and urged by a coil spring toward said forward surface, said retaining means having a forward end configured to penetrate said aperture, d) a flat plate affixed to said forward surface and thereby covering said groove in a manner to create a passage of rectangular configuration, and e) a straight handle held by said bore, and 2) a plurality of heads, each having a working extremity equipped with fixed parallel jaws adapted to engage the parallel surfaces of said fastener in close conformity therewith, an elongated mounting extremity adapted to slidably engage said passage and having a locking recess adapted to be engaged by the forward end of said retaining means, and a shoulder adapted to abut said block.

2. The wrench kit of claim 1 wherein the operational block of said wrench member is associated with the distal extremity of said shaft by way of a ratchet mechanism that permits rotation of said block in clockwise or counter clockwise direction.

3. The wrench kit of claim 1 wherein the retaining means of said wrench member is a straight rod, and has a forward end which is rounded.

4. The wrench kit of claim 3 wherein said retaining rod is equipped with an outwardly directed shoulder adapted to abut against said rearward surface.

* * * * *